US010717301B2

(12) United States Patent
Hachmann

(10) Patent No.: US 10,717,301 B2
(45) Date of Patent: Jul. 21, 2020

(54) WEB-FED PRINTING MACHINE

(71) Applicant: HEIDELBERGER DRUCKMASCHINEN AG, Heidelberg (DE)

(72) Inventor: Peter Hachmann, Weinheim-Hohensachsen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 16/360,241

(22) Filed: Mar. 21, 2019

(65) Prior Publication Data

US 2019/0291470 A1 Sep. 26, 2019

(30) Foreign Application Priority Data

Mar. 21, 2018 (EP) ..... 18163065

(51) Int. Cl.

| | |
|---|---|
| ***B41J 11/00*** | (2006.01) |
| ***B41J 11/04*** | (2006.01) |
| ***B65H 23/24*** | (2006.01) |
| ***B41J 15/00*** | (2006.01) |
| ***B41F 13/02*** | (2006.01) |

(52) U.S. Cl.

CPC ..... *B41J 11/002* (2013.01); *B41F 13/02* (2013.01); *B41J 11/0015* (2013.01); *B41J 11/04* (2013.01); *B41J 15/005* (2013.01); *B65H 23/24* (2013.01); *B65H 2301/31122* (2013.01); *B65H 2801/15* (2013.01)

(58) Field of Classification Search

CPC .... B41J 11/002; B41J 15/005; B41J 11/0015; B41J 11/04; B41J 2/21; B41J 15/00; B41J 15/04; B41J 15/02; B41F 13/02; B65H 23/24; B65H 2301/31122; B65H 2801/15

USPC ..... 347/102

See application file for complete search history.

(56) References Cited

U.S. PATENT DOCUMENTS

| | | | | |
|---|---|---|---|---|
| 3,061,159 | A * | 10/1962 | Jacobsen | B65H 23/1888 226/39 |
| 3,678,599 | A * | 7/1972 | Vits | B65H 23/24 34/641 |
| 3,807,612 | A | 4/1974 | Eggert | |
| 8,523,034 | B2 | 9/2013 | Fuchs et al. | |
| 2009/0244237 | A1 * | 10/2009 | Kachi | B41J 11/002 347/102 |

FOREIGN PATENT DOCUMENTS

| | | | |
|---|---|---|---|
| DE | 2365668 | A1 | 4/1976 |
| DE | 10032675 | A1 | 1/2002 |
| DE | 102007034246 | B4 | 10/2010 |

* cited by examiner

*Primary Examiner* — Huan H Tran
*Assistant Examiner* — Alexander D Shenderov
(74) *Attorney, Agent, or Firm* — Laurence A. Greenberg; Werner H. Stemer; Ralph E. Locher

(57) ABSTRACT

A printing machine for printing on a web includes a first roller and a second roller between which the web forms a loop. A trough for pneumatically guiding the loop equidistantly to the major part of the length of curvature of the trough is provided between the first roller and the second roller.

11 Claims, 4 Drawing Sheets

WEB-FED PRINTING MACHINE

CROSS-REFERENCE TO RELATED APPLICATION

This application claims the priority, under 35 U.S.C. § 119, of European application EP 18 163 065.8-1014, filed Mar. 21, 2018; the prior application is herewith incorporated by reference in its entirety.

BACKGROUND OF THE INVENTION

Field of the Invention

The present invention relates to a printing machine for printing on a web, the printing machine containing a first roller and a second roller between which the web forms a loop.

German patent DE 10 2007 034 246 B4, corresponding to U.S. Pat. No. 8,523,034, discloses a device for feeding a web of printing material to an internal transport path of a printing module in a printing device wherein a buffering device for receiving the web of printing material is provided. The buffering device has a buffer container that has a vacuum device at the bottom for creating a vacuum that acts on the web of printing material in the buffer container.

SUMMARY OF THE INVENTION

An object of the invention is to provide a printing machine for guiding a web of material in a gentle way.

This object is attained by a printing machine for printing on a web having a first roller and a second roller between which a web forms a loop and characterized in that a trough for pneumatically guiding the loop equidistantly relative to the major portion of the length of curvature of the trough is disposed between the first roller and the second roller.

Various further developments are possible.

The printing machine may be a digital printing machine, preferably for inkjet printing. The trough may have a one-dimensional curvature, which may have the shape of a circular arc. The trough may have only suction openings or only blower openings for guiding the loop.

The trough may have suction openings and blower openings for guiding the loop without contact. The suction openings and blower openings may simultaneously be active to maintain a defined distance between the web and the trough.

The suction openings may be grooves that run in parallel with the direction of transport or travel of the web or at an angle relative thereto. The grooves may preferably be parallel to one another or they may diverge from one another in the direction of travel, for instance to tauten the web in the transverse direction.

The blower openings may form nozzle rows that are disposed to alternate with the suction openings. The nozzle rows may consist of bores, for instance, that emit blown air in a radial direction with respect to the nozzle surface of the trough.

The trough may be disposed on the outer side of the loop and a support roller may be disposed on the inner side of the loop. In a trouble-free printing operation, the support roller is out of contact with the web. The force of the suction air of the suction openings and the force of the blown air of the blower openings may be balanced in a way for the web to run floatingly between the trough and the support roller without contact with the two. The support roller only needs to support the web when the suction air of the trough is deactivated, e.g. when the vacuum source connected to the trough fails or is switched off, for instance when the web is threaded in or another set-up operation takes place.

An inner circumferential surface of the trough and an outer circumferential surface of the support roller may be parallel to one another. The trough and the support roller may define a half-ring-shaped gap between one another through which the web passes without contact during the printing operation.

A format adjustment device for adapting the suction openings to the respective width of the web may be provided. The same format adjustment device or an additional format adjustment device may be used to adapt the blower openings to the respective width of the web. Each one of the format adjustment devices may be a valve with a slide lock.

The blower openings may be throttle nozzles that throttle the air flow by a filter insert or a channel maze. The filter insert may be a piece of foam material placed in the nozzle bore. The channel maze may be a perforated board maze forming a channel for connecting the blower openings to a blown-air source.

The first roller and/or the second roller may be (a) cooling roller(s) for cooling the web and a coolant fluid may flow through the cooling roller(s). For this purpose, every cooling roller may be integrated into a circulation system for circulating the cooling fluid by a pump.

The first roller, the second roller, and the trough may be disposed between a drying or pinning device and at least one downstream inkjet print head along the transport path of the web. The web-guiding system that include the two rollers and the trough may be disposed downstream of a base coat or primer coating unit, for instance for opaque white, and upstream of a device for multicolor inkjet printing with four or more print bars, for example.

Other features which are considered as characteristic for the invention are set forth in the appended claims.

Although the invention is illustrated and described herein as embodied in web-fed printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

In FIGS. 1 to 4, mutually corresponding components and elements have the same reference symbol.

Figure 1:
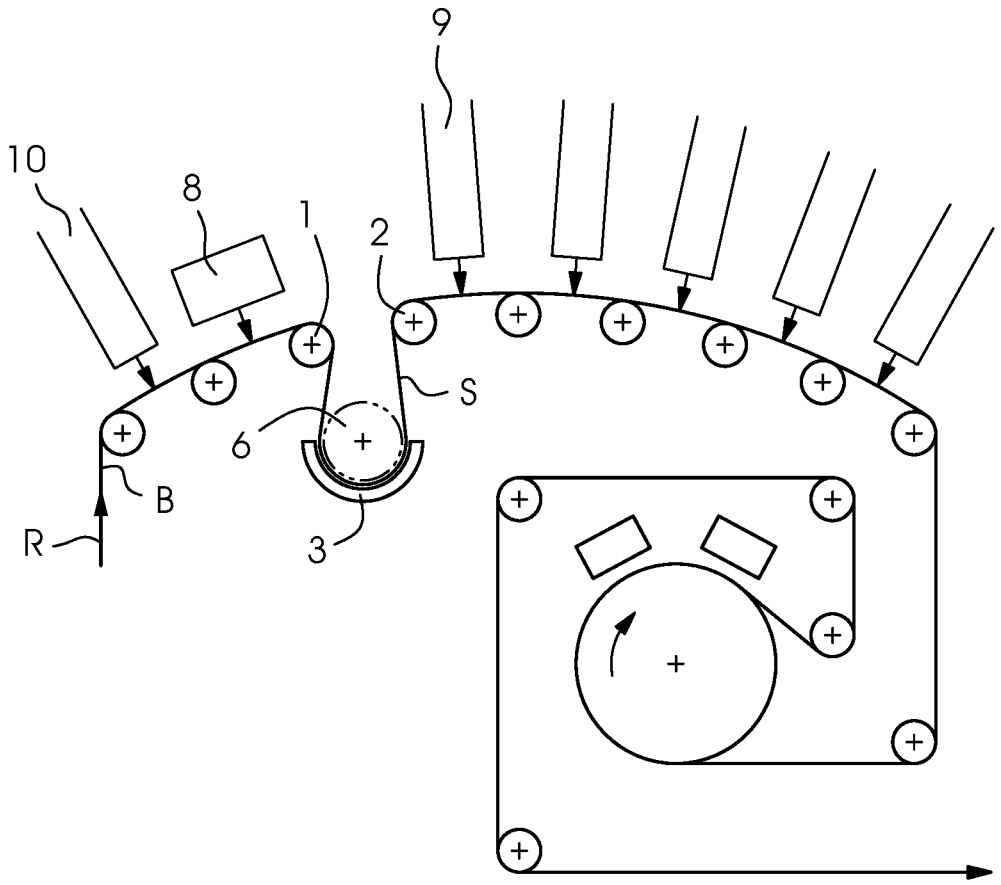
FIG. 1 is an illustration of a digital printing machine with a trough for guiding a web of printing material according to the invention.

Referring now to the figures of the drawings in detail and first, particularly to FIG. 1 thereof, there is shown an illustration of a digital printing machine through which a web B of printing material passing in a direction of travel R. Firstly a coating device 10 embodied as an inkjet print head applies a base coat or primer to the web B. The next step is to dry the applied base coat/primer by means of a pinning device 8. Finally one or more inkjet print heads 9 print an image onto the base coat/primer.

A first roller 1 and a second roller 2 are disposed between a pinning device 8 and an inkjet print head 9 along a web B and a trough 3 and a support roller 6 are disposed between the two rollers 1, 2. The web B forms a noose or loop S between the two rollers 1, 2. The trough 3 is disposed on the same side of the web B as the rollers 1, 2, namely on the back side of the web B, i.e. the side that has not been coated by a coating device 10. On the opposite side, namely on the front side of the web B, i.e. the side that has been coated by the web B, there is the support roller 6.

During a printing operation, the trough 3 acts to keep the loop S stable, ensuring that the web B wraps around each one of the rollers 1, 2 over a maximized circumferential angle. As a consequence, the area of contact between the web B and the roller 1 or 2 is large and thus the transfer of heat from the web B to the respective roller 1 or 2 is maximized accordingly.

When the web B is treated by the pinning device 8, the web B is heated. This is an undesired side effect that cannot be avoided. The heating of the web B would affect the print quality of the web B when it is printed by the ink jet print head 9 if no countermeasures were taken. Without countermeasures, longitudinal creases that would be visible in the image printed by the inkjet print head 9 would occur in the web B.

The countermeasure is to cool the web B by means of one of the rollers 1, 2 or preferably both of them, which are embodied as cooling rollers for this purpose. A coolant such as water flows through the rollers 1, 2, causing the temperature of the web B to be reduced down to a value at which longitudinal creases no longer occur and there is no detrimental effect on the downstream inkjet print as a consequence.

Figure 2:
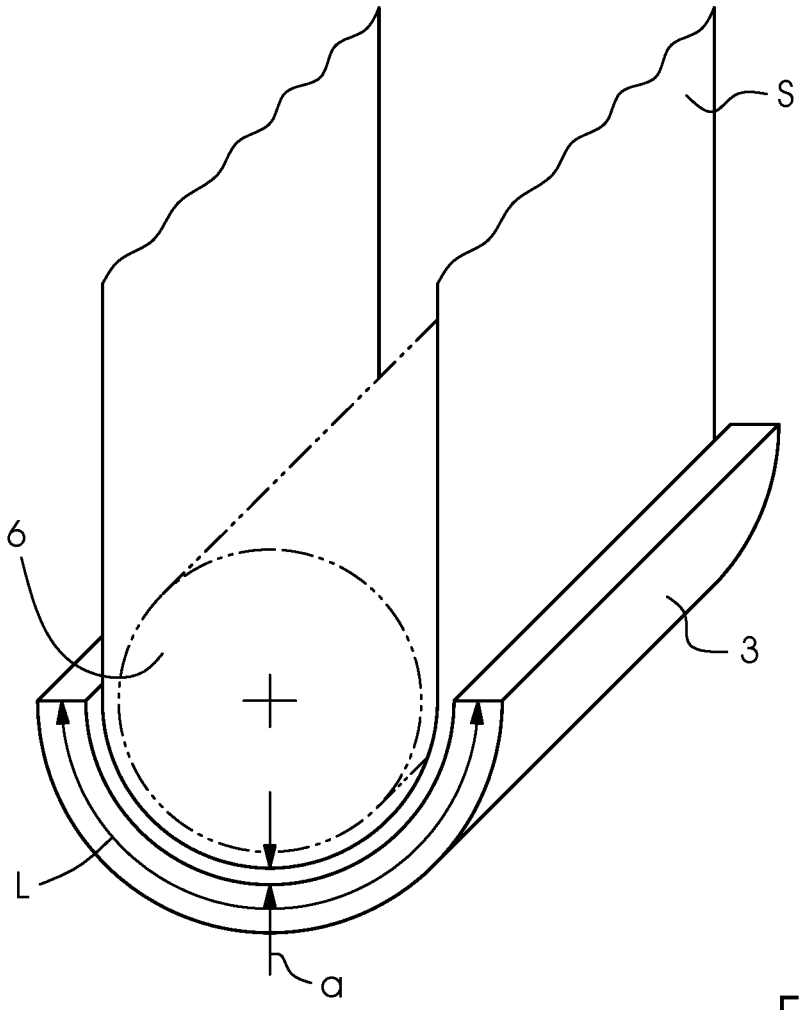
FIG. 2 is a perspective view of the guide trough together with a support roller.

FIG. 2 shows that the trough 3 has a length of curvature L. In the present case of a trough 3 ideally shaped like a circular arc, the length L is a length of a circular arc. In a trouble-free printing operation, a gap of a width or distance a is present between the running web B and the web-facing nozzle surface of the trough 3. This width a is constant along almost the entire length of curvature L. Due to pneumatic peculiarities in the two end sections of the length of curvature L, namely in the entry region and the exit region of the web B, the distance a may be different, for instance smaller than in the main section of the length of curvature L between the two end sections.

Figure 3:
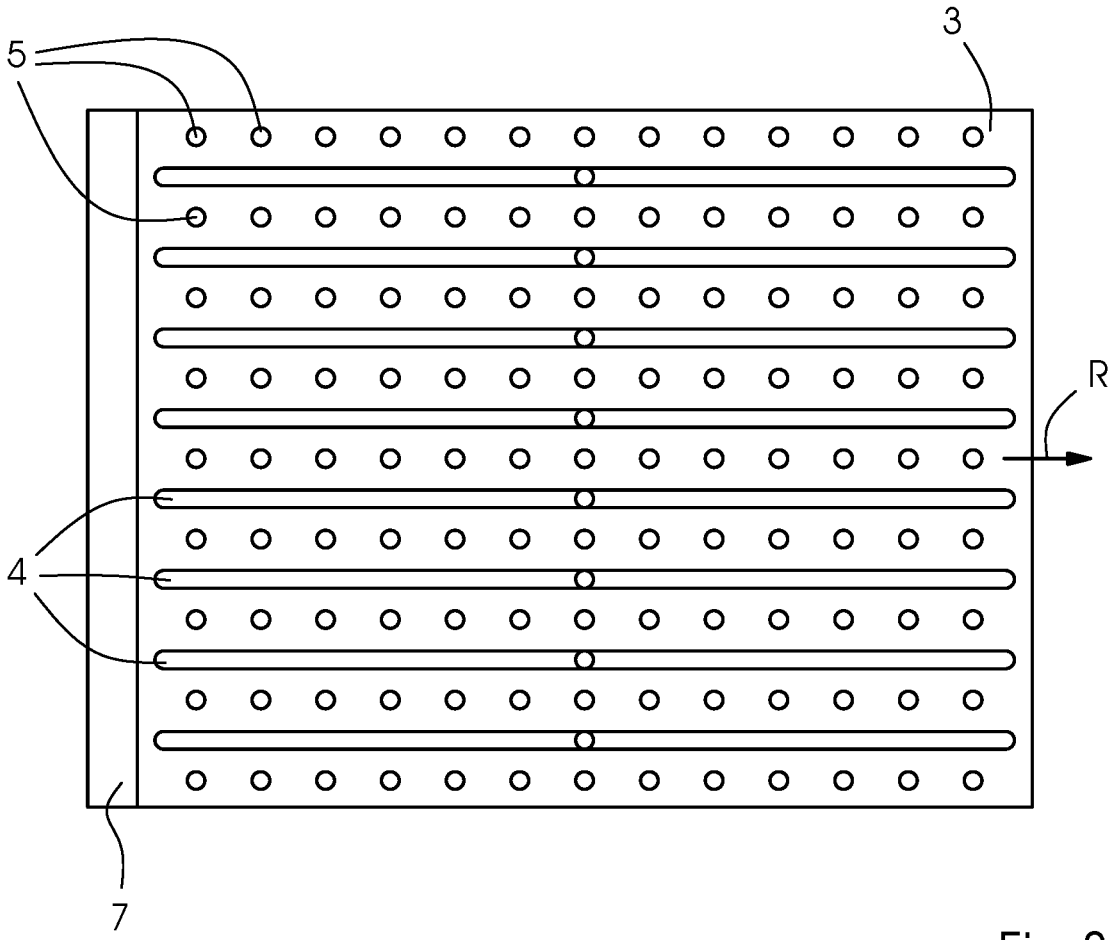
FIG. 3 is an illustration of a nozzle surface of the guide trough.

FIG. 3 is a top view of the web-facing nozzle surface of the trough 3, showing the trough 3 as an individual part in an unwound state. The guide surface or nozzle surface of the trough 3 has a one-dimensional curvature and the center of curvature is the geometric axis of rotation of the support roller 6. Thus the inner circumferential surface or guide surface of the trough 3 is concentric with the outer circumferential surface of the support roller 6 (cf. FIG. 2).

Suction openings 4 and blower openings 5 are formed in the guide or nozzle surface. A format adjustment device 7 connects the suction openings 4 to a vacuum source (not shown in any detail) and the blower openings 5 to a compressed-air source (not shown in any detail).

The blower openings 5 are embodied as throttle nozzles and arranged in rows that are parallel to the direction of travel of the web B. The suction openings 4 are embodied as grooves that likewise extend in parallel with the direction of travel R. As viewed in a direction transverse to the direction of travel R, the suction openings 4 and the blower openings 5 are arranged in an alternating way.

As an alternative to the pattern shown in FIG. 3, there may be several rows of throttle nozzles between two suction grooves and/or there may be several suction grooves between two rows of throttle nozzles.

The format adjustment device 7, which is only schematically shown in the drawing, may deactivate those suction openings 4 and/or blower openings 5 that are outside the format width of the web B and are not covered by the latter.

The vacuum source and the compressed-air source may be set to balance the force of the vacuum applied to the suction openings 4 and the force of the blown air emitted by the blower openings 5 in such a way that the web B, which is simultaneously subjected to suction by the suction openings 4 and carried on an air cushion by the blower openings 5, floatingly passes between the trough 3 and the support roller 6, contacting neither as long as the printing operation remains trouble-free.

The web B may contact the support roller 6 and wrap around the latter during a disturbance in the printing operation or during an intentional or unintentional disruption of the printing operation. If the web B continues to run during a disturbance or interruption of the printing operation, the web B may drive the support roller 6 that it is wrapped around by circumferential surface friction. In this respect, the support roller 6 may not have a drive of its own and may co-run with the web B.

In a trouble-free printing operation, the image printed by the coating device, which has not yet been completely dried or cured by the pinning device 8, is guaranteed to be protected against damage because the printed image does not get into contact with the support roller 6. The trough 3, which guides the web B without contact, ensures that the web is guided in a very gentle way.

Figure 4:
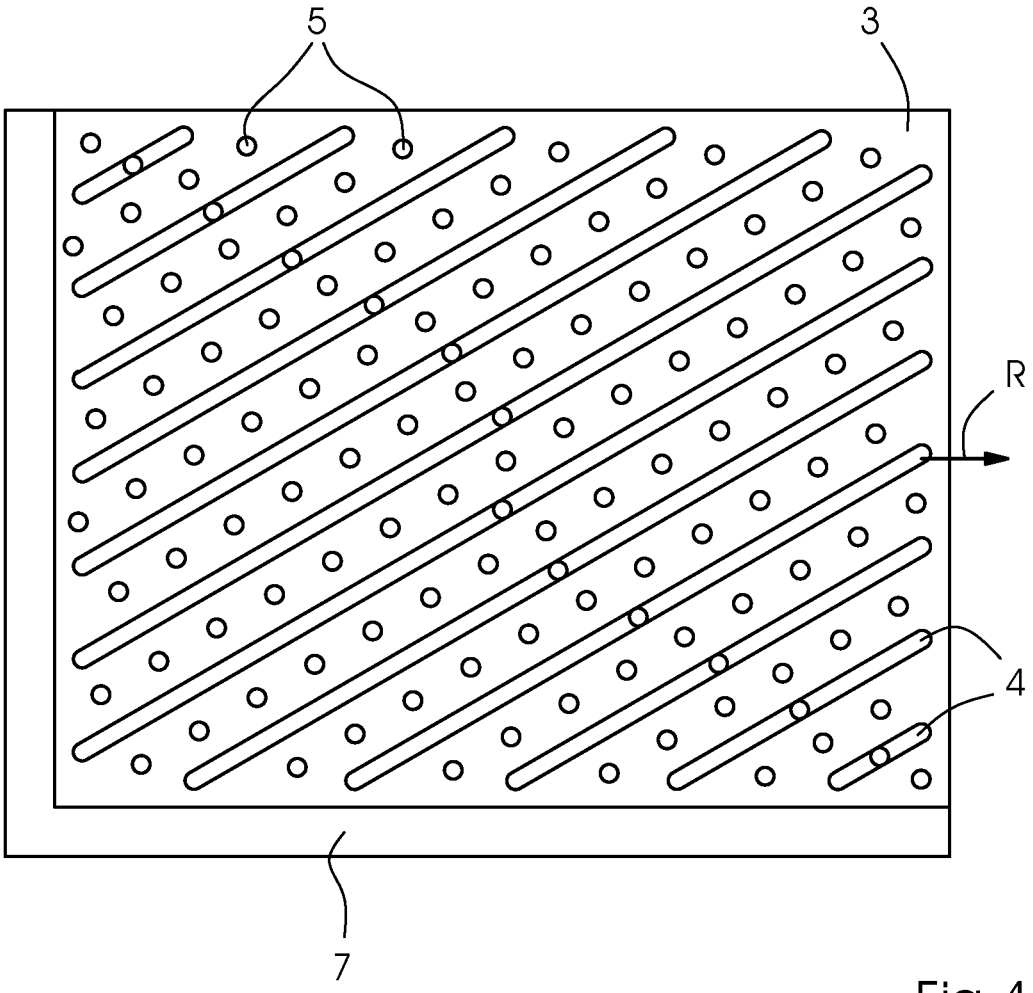
FIG. 4 is an illustration of a modified nozzle surface.

FIG. 4 illustrates a modification that differs from the example illustrated in FIG. 3 only in as much as the grooves (suction openings 4) and the throttle nozzle rows (blower openings 5) extend at an angle, preferably an acute angle, relative to the direction of travel R of the web B.

The following is a summary list of reference numerals and the corresponding structure used in the above description of the invention:

1 first roller
2 second roller
3 trough
4 suction opening
5 blower opening
6 support roller
7 format adjustment device
8 pinning device
9 ink jet print head
10 coating device
a distance
B web
L length of curvature
R running direction
S loop

The invention claimed is:

1. A printing machine for printing on a web, the printing machine comprising:

a first roller;

a second roller and between said first and second rollers the web forms a loop; and a trough for pneumatically guiding the loop equidistantly relative to a major part of a length of curvature of said trough and said trough disposed between said first roller and said second roller, wherein said trough having suction openings and blower openings formed therein for guiding the loop in a contact-free way.

2. The printing machine according to claim 1, wherein said suction openings are grooves extending to be either parallel to a travelling direction of the web or at an angle relative to the travelling direction.

3. The printing machine according to claim 1, wherein said blower openings form nozzle rows that are disposed to alternate with said suction openings.

4. The printing machine according to claim 1, further comprising a format adjustment device for adjusting said suction openings to a respective width of the web.

5. The printing machine according to claim 1, wherein said blower openings are throttle nozzles that throttle air flow by means of a filter insert or a channel maze.

6. The printing machine according to claim 1, further comprising a drying or pinning device;

further comprising at least one downstream inkjet print head; and wherein said first roller, said second roller and said trough are disposed between said drying or pinning device and said at least one downstream inkjet print head along a transport path of the web.

7. A printing machine for printing on a web, the printing machine comprising:

a first roller;

a second roller and between said first and second rollers the web forms a loop;

a trough for pneumatically guiding the loop equidistantly relative to a major part of a length of curvature of said trough and said trough disposed between said first roller and said second roller;

a support roller; and wherein said trough is disposed on an outer side of the loop and said support roller that is out of contact with the web during a trouble-free printing operation is disposed on an inner side of the loop.

8. The printing machine according to claim 7, wherein an inner circumferential surface of said trough and an outer circumferential surface of said support roller are parallel to one another.

9. The printing machine according to claim 7, further comprising a drying or pinning device;

further comprising at least one downstream inkjet print head; and wherein said first roller, said second roller and said trough are disposed between said drying or pinning device and said at least one downstream inkjet print head along a transport path of the web.

10. A printing machine for printing on a web, the printing machine comprising:

a first roller;

a second roller and between said first and second rollers the web forms a loop;

a trough for pneumatically guiding the loop equidistantly relative to a major part of a length of curvature of said trough and said trough disposed between said first roller and said second roller; and wherein said first roller and/or said second roller is a cooling roller through which a cooling fluid flows to cool the web.

11. The printing machine according to claim 10, further comprising a drying or pinning device;

further comprising at least one downstream inkjet print head; and wherein said first roller, said second roller and said trough are disposed between said drying or pinning device and said at least one downstream inkjet print head along a transport path of the web.

* * * * *